US006453289B1

(12) United States Patent
Ertem et al.

(10) Patent No.: US 6,453,289 B1
(45) Date of Patent: Sep. 17, 2002

(54) METHOD OF NOISE REDUCTION FOR SPEECH CODECS

(75) Inventors: Filiz Basbug Ertem, McLean, VA (US); Srinivas Nandkumar, Silver Spring; Kumar Swaminathan, North Potomac, both of MD (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/361,015

(22) Filed: Jul. 23, 1999

Related U.S. Application Data

(60) Provisional application No. 60/094,100, filed on Jul. 24, 1998.

(51) Int. Cl.[7] ..... G10L 21/02

(52) U.S. Cl. ..... 704/225; 704/226; 704/227; 704/228; 704/233

(58) Field of Search ..... 704/226, 227, 704/228, 230, 207, 220, 258, 215, 233, 219, 214, 243, 205, 208, 225, 210, 231, 264, 200.1

(56) References Cited

U.S. PATENT DOCUMENTS

| | | | | |
|---|---|---|---|---|
| 4,868,867 A | | 9/1989 | Davidson et al. | 381/36 |
| 4,969,192 A | | 11/1990 | Chen et al. | 381/31 |
| 5,133,013 A | * | 7/1992 | Munday | 704/233 |
| 5,388,182 A | | 2/1995 | Benedetto et al. | 395/2.14 |
| 5,432,859 A | * | 7/1995 | Yang et al. | 704/233 |
| 5,550,924 A | * | 8/1996 | Helf et al. | 704/233 |
| 5,687,285 A | | 11/1997 | Katayanagi et al. | 395/2.35 |
| 5,706,394 A | * | 1/1998 | Wynn | 704/219 |
| 5,734,789 A | | 3/1998 | Swaminathan et al. | 395/2.15 |
| 5,737,695 A | | 4/1998 | Lagerqvist et al. | 455/79 |
| 5,742,927 A | | 4/1998 | Crozier et al. | 704/226 |
| 5,749,067 A | | 5/1998 | Barrett | 704/233 |
| 5,774,837 A | | 6/1998 | Yeldener et al. | 704/208 |
| 5,774,839 A | | 6/1998 | Shlomot | 704/222 |
| 5,774,846 A | | 6/1998 | Morii | 704/232 |
| 5,826,224 A | | 10/1998 | Gerson et al. | 704/222 |
| 5,890,108 A | * | 3/1999 | Yeldener | 704/208 |
| 5,899,968 A | | 5/1999 | Navarro et al. | 704/220 |
| 5,937,377 A | * | 8/1999 | Hardimann et al. | 704/225 |
| 6,230,123 B1 | * | 5/2001 | Mekuria et al. | 704/226 |

OTHER PUBLICATIONS

Manfred R. Schroeder, "Code–Exicted Linear Prediction (CELP): High–Quality Speech at Very Low Bit Rates", Proc. ICASSP '85, pp. 937–940, 1985.

Walter Etter, "Noise Reduction by Noise–Adaptive Spectral Magnitude Expansion", J. Audio Eng. Soc., vol. 42, No. 5, May 1994.

Peter M. Clarkson and Sayed F. Bahgat, "Envelope expansion methods for speech enhancement", J. Acoust. Soc. Am., vol. 89, No. 3, Mar. 1991.

Bertram Scharf, "Critical Bands", Foundations of Modern Auditory Theory, J.V. Tobias ed., Academic Press, 1970.

* cited by examiner

*Primary Examiner*—Vijay B Chawan
(74) *Attorney, Agent, or Firm*—John T. Whelan; Michael W. Sales

(57) ABSTRACT

An improved noise reduction algorithm is provided, as well as a voice activity detector, for use in a voice communication system. The voice activity detector allows for a reliable estimate of noise and enhancement of noise reduction. The noise reduction algorithm and voice activity detector can be implemented integrally in an encoder or applied independently to speech coding application. The voice activity detector employs line spectral frequencies and enhanced input speech which has undergone noise reduction to generate a voice activity flag. The noise reduction algorithm employs a smooth gain function determined from a smoothed noise spectral estimate and smoothed input noisy speech spectra. The gain function is smoothed both across frequency and time in an adaptive manner based on the estimate of the signal-to-noise ratio. The gain function is used for spectral amplitude enhancement to obtain a reduced noise speech signal. Smoothing employs critical frequency bands corresponding to the human auditory system. Swirl reduction is performed to improve overall human perception of decoded speech.

41 Claims, 8 Drawing Sheets

METHOD OF NOISE REDUCTION FOR SPEECH CODECS

This application claims the benefit of U.S. Provisional Application No. 60/094,100, filed Jul. 24, 1998.

FIELD OF THE INVENTION

The invention relates to noise reduction and voice activity detection in speech communication systems.

BACKGROUND OF THE INVENTION

The presence of background noise in a speech communication system affects its perceived grade of service in a number of ways. For example, significant levels of noise can reduce intelligibility, cause listener fatigue, and degrade performance of the speech compression algorithm used in the system.

Reduction of background noise levels can mitigate such problems and enhance overall performance of the speech communication system. In the highly competitive area of communications, improved voice quality is becoming an increasingly important concern to customers when making purchasing decisions. Since noise reduction can be an important element for overall improved voice quality, noise reduction can have a critical impact on these decisions.

Voice encoding and decoding devices (hereinafter referred to as "codecs") are used to encode speech for more efficient use of bandwidth during transmission. For example, a code excited linear prediction (CELP) codec is a stochastic encoder which analyzes a speech signal and models excitation frames therein using vectors selected from a codebook. The vectors or other parameters can be transmitted. These parameters can then be decoded to produce synthesized speech. CELP is particularly useful for digital communication systems wherein speech quality, data rate and cost are significant issues.

A need exists for a noise reduction algorithm which can enhance the performance of a codec. Noise reduction algorithms often use a noise estimate. Since estimation of noise is performed during input signal segments containing no speech, reliable noise estimation is important for noise reduction. Accordingly, a need also exists for a reliable and robust voice activity detector.

SUMMARY OF THE INVENTION

In accordance with an aspect of the present invention, a noise reduction algorithm is provided to overcome a number of disadvantages of a number of existing speech communication systems such as reduced intelligibility, listener fatigue and degraded compression algorithm performance.

In accordance with another aspect of the present invention, a noise reduction algorithm employs spectral amplitude enhancement. Processes such as spectral subtraction, multiplication of noisy speech via an adaptive gain, spectral noise subtraction, spectral power subtraction, or an approximated Wiener filter, however, can also be used.

In accordance with another aspect of the present invention, noise estimation in the noise reduction algorithm is facilitated by the use of information generated by a voice activity detector which indicates when a frame comprises noise. An improved voice activity detector is provided in accordance with an aspect of the present invention which is reliable and robust in determining the presence of speech or noise in the frames of an input signal.

In accordance with yet another aspect of the present invention, wherein gain for the noise reduction algorithm is determined using a smoothed noise spectral estimate and smoothed input noisy speech spectra. Smoothing is performed using critical bands comprising frequency bands corresponding to the human auditory system.

In accordance with still yet another aspect of the present invention, the noise reduction algorithm can be either integrated in or used with a codec. A codec is provided having voice activity detection and noise reduction functions integrated therein. Noise reduction can coexist with a codec in a pre-compression or post-compression configuration.

In accordance with another aspect of the present invention, background noise in the encoded signal is reduced via swirl reduction techniques such as identifying spectral outlier segments in an encoded signal and replacing line spectral frequencies therein with weighted average line spectral frequencies. An upper limit can also be placed on the adaptive codebook gain employed by the encoder for those segments identified as being spectral outlier segments. A constant C and a lower limit K are selected for use with the gain function to control the amount of noise reduction and spectral distortion introduced in cases of low signal to noise ratio.

In accordance with another aspect of the present invention, a voice activity detector is provided to facilitate estimation of noise in a system and therefore a noise reduction algorithm using estimated noise such as to determine a gain function.

In accordance with yet another aspect of the present invention, the voice activity detector determines pitch lag and performs periodicity detection using enhanced speech which has been processed to reduce noise therein.

In accordance with still yet another aspect of the present invention, the voice activity detector subjects input speech to automatic gain control.

In accordance with an aspect of the present invention, a voice activity detector generates short-term and long-term voice activity flags for consideration in detecting voice activity.

In accordance with yet another aspect of the present invention, a noise flag is generated using an output from a voice activity detector and is provided as an input to the noise reduction algorithm.

In accordance with another aspect of the present invention, an integrated coder is provided with noise reduction algorithm via either a post-compression or a pre-compression scheme.

BRIEF DESCRIPTION OF DRAWINGS

The various aspects, advantages and novel features of the present invention will be more readily comprehended from the following detailed description when read in conjunction with the appended drawings, in which.

Throughout the drawing figures, like reference numerals will be understood to refer to like parts and components.

DETAILED DESCRIPTION OF THE PREFERRED EMBODIMENTS

As stated previously, the presence of background noise in a speech communication system affects its perceived grade of service. High levels of noise can reduce intelligibility, cause listener fatigue, and degrade performance of the speech compression algorithm used in the system. Reduction of background noise levels can mitigate such problems and enhance overall performance of the speech communication system. In accordance with the present invention, a noise reduction algorithm is provided. The noise reduction algorithm can be integrated with a codec such as the TIA IS-641 standard codec which is an enhanced full-rate codec for TIA IS-136 systems. It is to be understood, however, that the noise reduction algorithm can be used with other codecs or systems.

Figure 1:
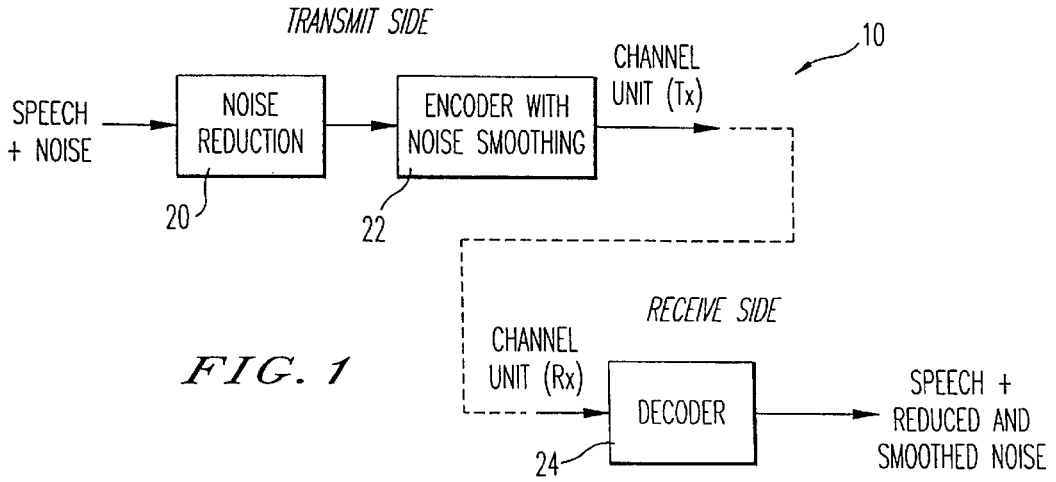
FIG. 1 is a block diagram of a speech communication system employing noise reduction prior to transmission in accordance with an aspect of the present invention.
Figure 2:
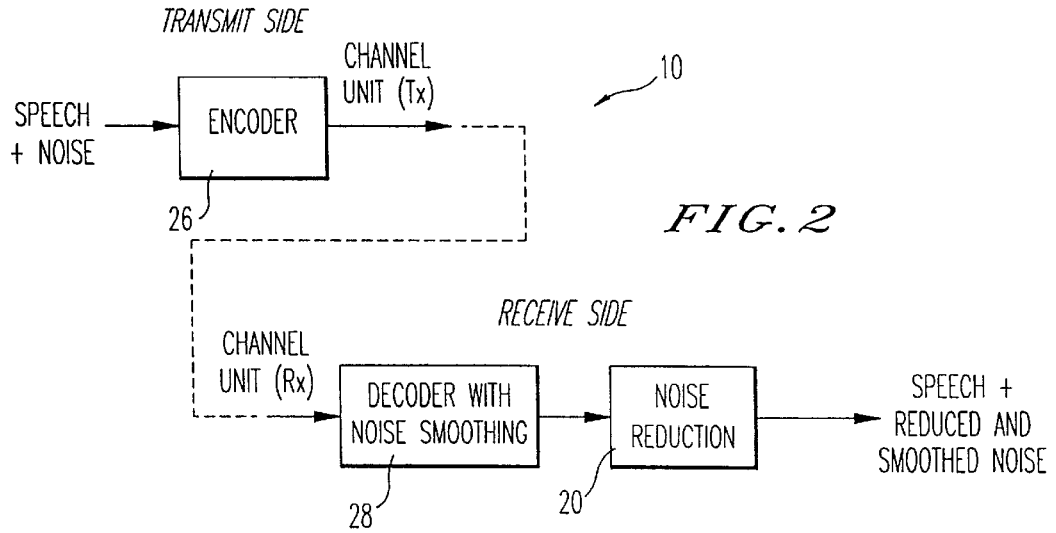
FIG. 2 is a block diagram of a speech communication system employing noise reduction following transmission in accordance with an aspect of the present invention.

With reference to FIGS. 1 and 2, the noise reduction algorithm can be implemented in a pre-compression mode or in a post-compression mode, respectively. In a pre-compression mode, noise reduction 20 occurs prior to speech encoding via encoder 22 and decoding via a speech decoder 24. In a post-compression mode, noise reduction 20 occurs after transmission by a speech encoder 26 and synthesis by a speech decoder 28.

The proposed noise reduction algorithm belongs to a class of single microphone solutions. The noise reduction is performed by a proprietary spectral amplitude enhancement technique. A reliable estimate of the background noise, which is essential in single microphone techniques, is obtained using a robust voice activity detector.

In accordance with an embodiment of the present invention, an integrated IS-641 enhanced full-rate codec with noise reduction is preferably implemented for both pre-compression and post-compression modes using a nGER31/PC board having a TMS320C3x 32-bit floating point digital signal processing (DSP) integrated circuit at 60 MHz. The basic principles of the noise reduction algorithm of the present invention, however, allow the noise reduction algorithm to be used with essentially any speech coding algorithm, as well as with other coders and other types of systems. For example, the noise reduction algorithm can be implemented with a US-1 (GSM-EFR) coder, which is used with TIA IS-136 standard systems. In general, no degradation in performance is expected when noise reduction is applied to other coders having rates similar to or higher than that of a TIA IS-641 coder.

A TIA IS-641 speech coder is an algebraic code excited linear prediction (ACELP) coder which is a variation on the CELP coder. The IS-641 speech coder operates on speech frames having 160 samples each, and at a rate of 8000 samples per second. For each frame, the speech signal is analyzed and parameters such as linear prediction (LP) filter coefficients, codebook indices and gains are extracted. After these parameters are encoded and transmitted, the parameters are decoded at the decoder, and are synthesized by passing through the LP synthesis filter.

With continued reference to FIGS. 1 and 2, a noise reduction algorithm module 20 is placed at the input of a communication system 10 in the pre-compression mode. In this configuration, the module 20 has immediate access to noisy input speech signals. Thus, when the speech signal reaches the noise reduction module 20, it has not been subjected to degradations caused by the other elements of the system 10. The speech signal at the output of the system 10 therefore is less distorted than when operating in a post-compression mode. In the post-compression mode, the noise reduction module has, as its input, a previously distorted signal caused by the encoder and the decoder. Thus, it is more difficult for the noise reduction module 20 to produce a low distortion output signal in the post-compression mode. Because of these considerations, the post-compression mode is discussed separately below in conjunction with FIGS. 9, 10 and 11. The pre-compression mode is the preferred configuration with regard to noise reduction integrated in an encoder and will now be described with reference to FIGS. 3 through 8.

Figure 3:
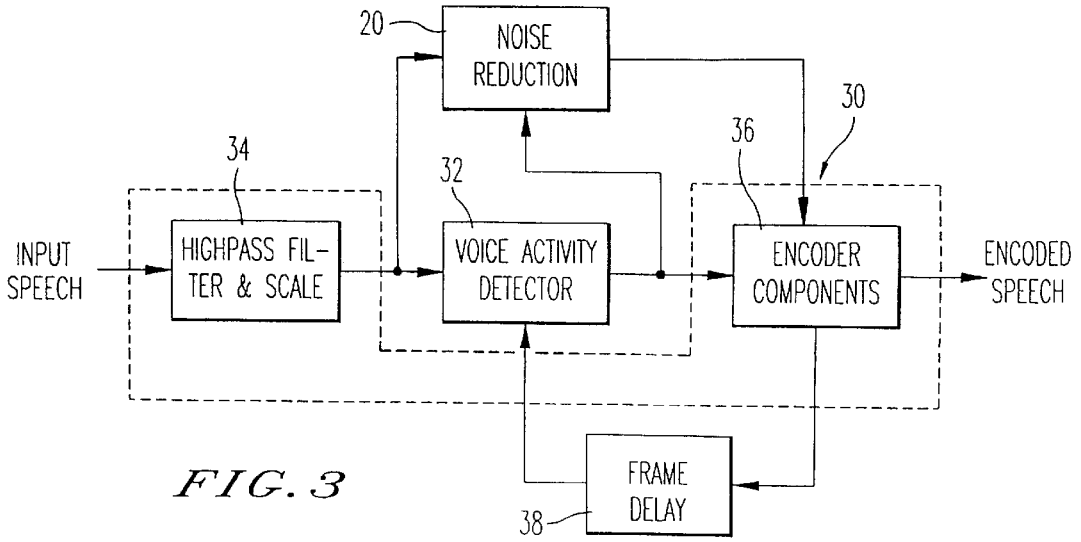
FIG. 3 is a block diagram of an enhanced encoder having integrated noise reduction and voice activity functions configured in accordance with an embodiment of the present invention.

As shown in FIG. 3, an encoder 30 having integrated noise reduction in accordance with the present invention comprises a voice activity detector (VAD) 32 and a noise reduction module 20. The VAD 32 is preferably an enhanced VAD in accordance with the present invention and described below in connection with FIG. 5. The noise reduction module 20 shall be described below in connection with FIG. 7. The encoder 30 comprises a high pass filter HPF) and scale module 34 in a manner similar to a standard IS-641 encoder. The HPF and scale module 34 is represented in FIG. 3 here as a separate unit from a module 36 comprising other encoder components in order to illustrate the locations of the VAD 32 and the noise reduction module 20 with respect to the rest of the system. A frame delay 38 occurs as a result of the VAD using parameters from an earlier frame and provided by the encoder.

Figure 4:
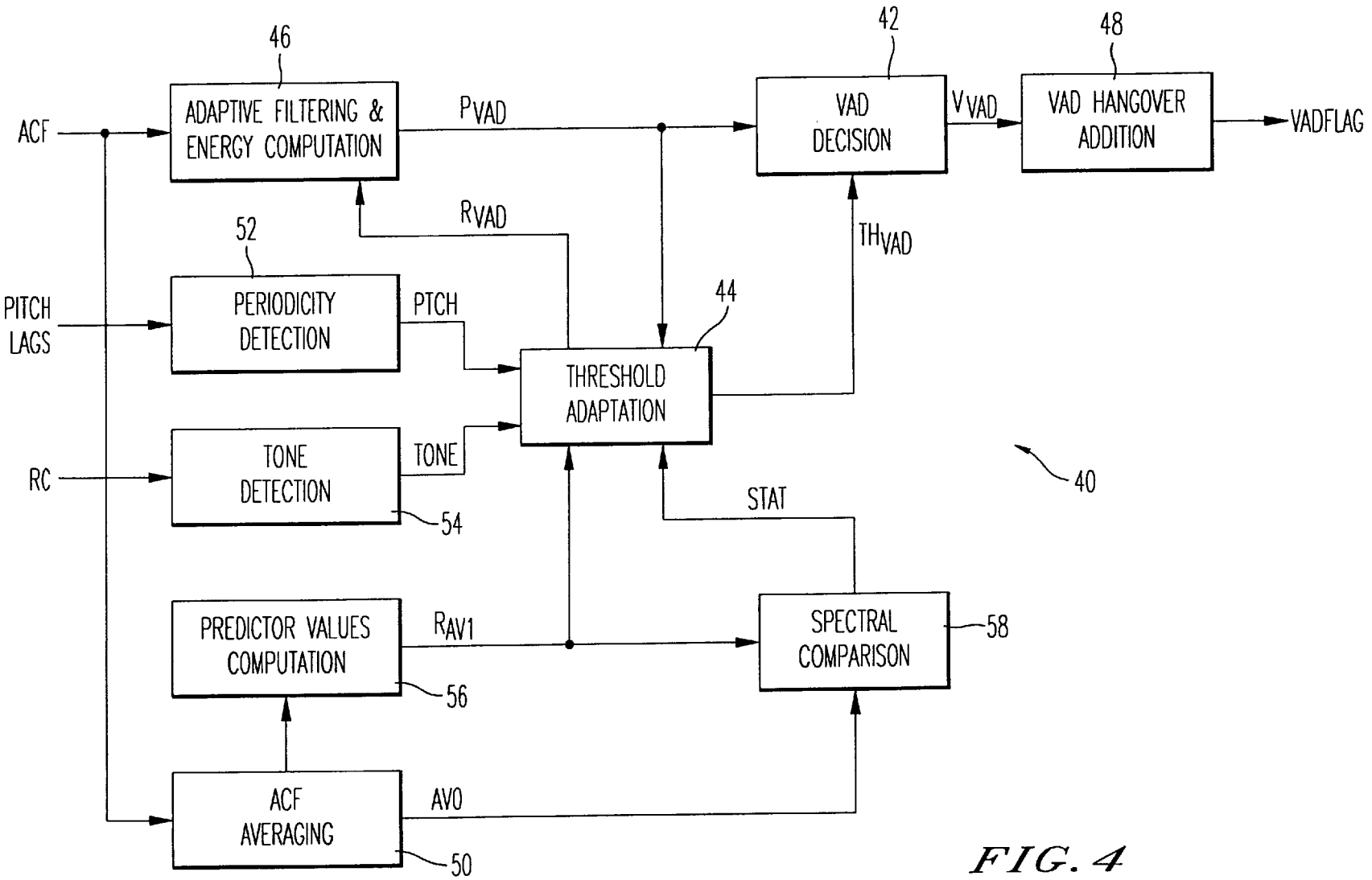
FIG. 4 is a block diagram of a conventional voice activity detector.
Figure 5:
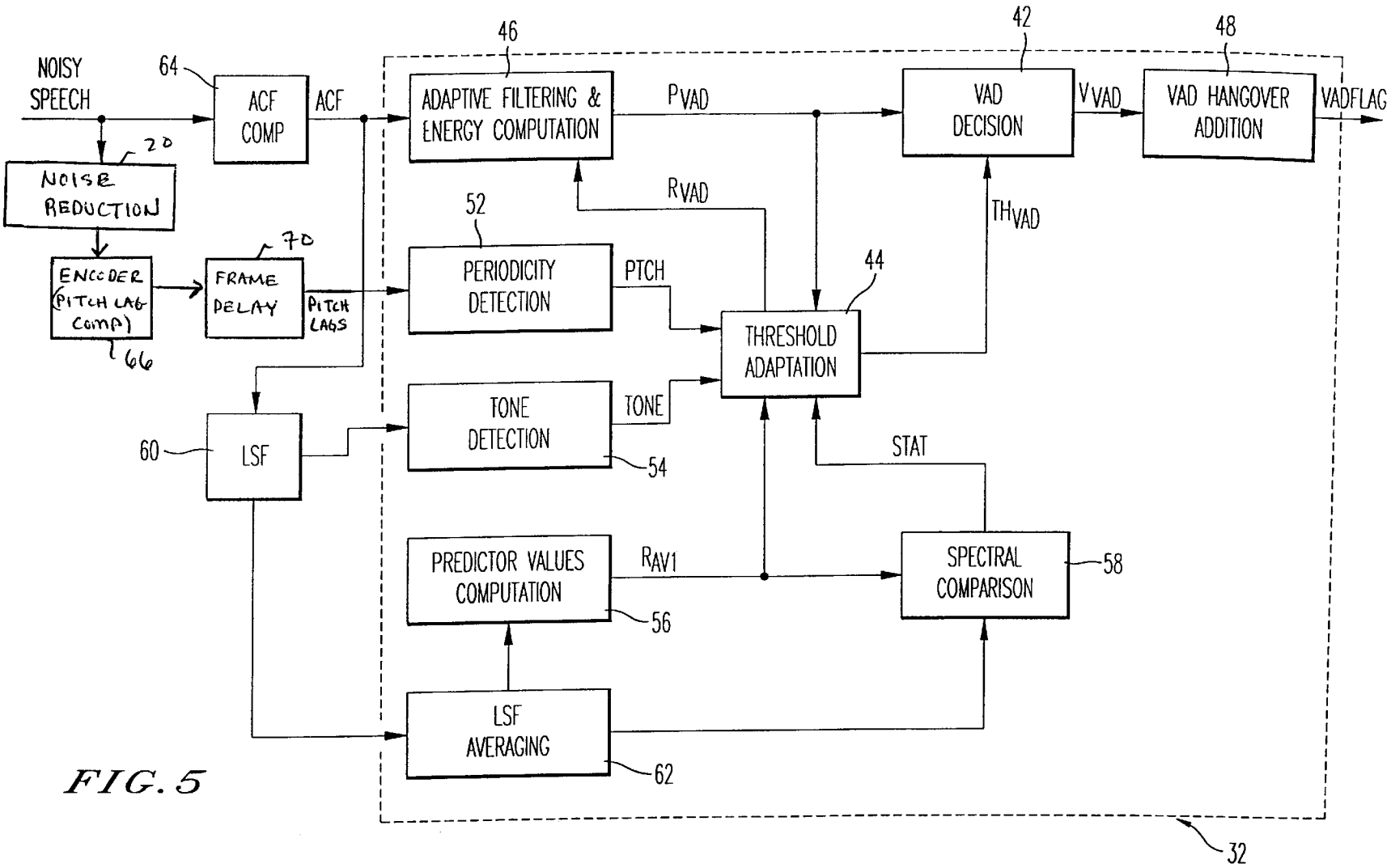
FIG. 5 is a block diagram of a voice activity detector configured in accordance with an embodiment of the present invention.

A conventional IS-641 VAD 40 will now be described with reference to FIG. 4 for comparison below to a VAD configured as shown in FIG. 5 and in accordance with an embodiment of the present invention. The function of a VAD is to determine at every frame whether there is speech present in that current frame. The IS-641 VAD is primarily intended for the implementation of the discontinuous transmission (DX) mode of the encoder. The IS-641 VAD is typically used in IS-136/IS-136+ systems in the uplink direction from mobile units to a base station in order to extend the mobile unit battery life. In the present invention, however, the VAD is used to obtain a noise estimate for noise reduction.

As shown in FIG. 4, the reference VAD 40 accepts as its inputs autocorrelation function (ACF) coefficients of the current analysis frame, reflection coefficients (roc) computed from the linear prediction coefficient (LPC) parameters, and long-term predictor or pitch lags. The initial VAD decision 42 depends on a VAD threshold 44 and the signal energy 46 in the current frame. According to this, the VAD decision 42 takes the form:

$$\text{Initial VAD Decision} = \begin{cases} 1, & \text{if } Energy > THRESHOLD \\ 0, & \text{Otherwise.} \end{cases} \quad (1)$$

Therefore, if the current frame energy exceeds an adaptive threshold, speech activity is declared (e-g., $V_{vad}$).

The overall VAD decision (e.g., vadflag) is determined by adding a hangover factor 48 to the initial VAD decision 42. The hangover factor 48 ensures that the VAD 40 indicates voice activity for a certain number frames after the initial VAD decision 42 transitions from an active state to an inactive state, provided that the activity indicated by the initial VAD decision 42 was at least a selected number of frames in length. Use of a hangover factor reduces clipping.

A number of the basic principles of operation of a IS-641 VAD 40 will now be summarized. When determining the input energy variable $P_{va}$ an adaptively filtered version 46 of the input is used instead of calculating the energy directly from the ACF input. The filtering 46 reduces the noise content of the input signal so that a more accurate energy value 46 can be used in the VAD decision 42. This, in turn, yields a more accurate VAD decision 42. The threshold for determining if a frame contains speech is adapted in accordance with a number of inputs such as periodicity detection 52, tone detection 54, predictor values computation and spectral comparison 58. ACF averaging 50 (i.e., by processing ACF values from the last several frames) facilitates monitoring of longer-term spectral characteristics (i.e., characteristics occurring over a period longer than just one frame length) which is important for stationarity flag determination. The presence of background noise is determined from its stationarity property. Since the voice speech and information tones also have the same property, precautions are made to ensure these tones are not present. Since these principles contribute to the robustness of the VAD 40 with respect to background noise, the principles are also used for the enhanced VAD 32 of the present invention.

A number of changes are made to the operations of the reference VAD module 40 in accordance with the present invention. With reference to FIG. 5, one such change is the use of line spectral frequencies (LSFs) 60, as opposed to autocorrelation function coefficients (ACFs) for functions such as tone detection 54, predictor values computation 56, and spectral comparison 58. This change allows for some reductions in computational complexity. To obtain the reflection coefficients from the LPC parameters, additional computations are needed. The LSF parameters, however, are already computed in the encoder 30, and they can be used in a similar manner as the reflection coefficients for the above mentioned functions.

A second change is, after the addition of an integrated noise reduction module 20, the input to the pitch lag computation 66 is no longer the noisy speech, but rather the speech which has passed through the noise reduction module 20. The enhanced speech signal yields better pitch lag estimates.

The performance of this particular VAD 32 is optimized for signals that are at the nominal level of −26 dBov. The definition of dBov is provided later in the text. Performance can be evaluated by considering two types of errors. Type I error is the percentage of speech active frames classified by the VAD as inactive frames. Type I error is a measure of total clipping. A high amount of Type I error is problematic for a noise estimation function since speech frames are classified as noise, which distorts a noise estimate, and, as a result, the output speech. Type II error indicates the percentage of speech inactive frames that are classified as active frames. For noise reduction purposes, a high Type II error implies that fewer frames are available from which to estimate noise characteristics. Hence, a less accurate noise estimate causes poorer noise reduction.

Figure 6:
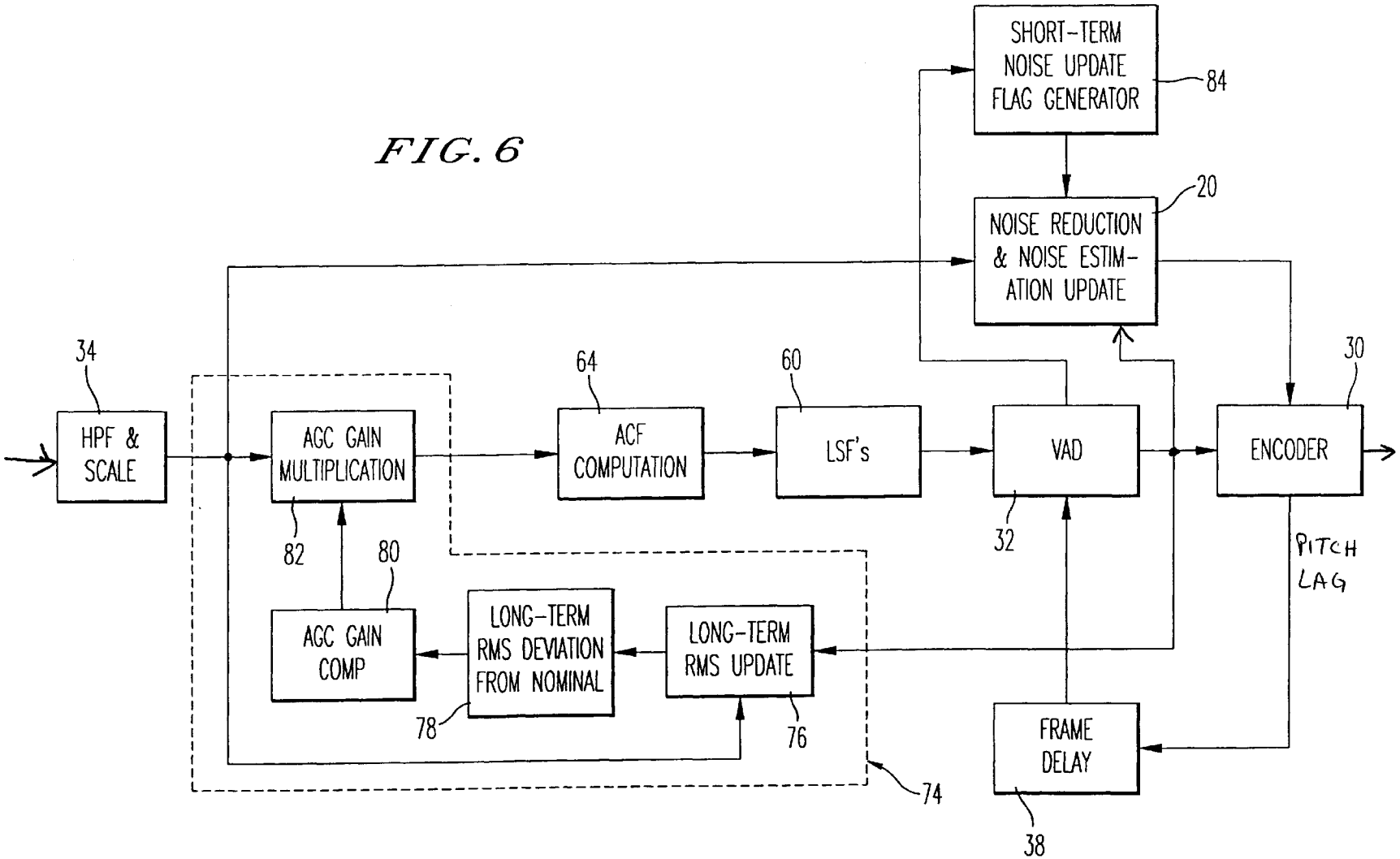
FIG. 6 is a block diagram of a voice activity detector configured with automatic gain control in accordance with an embodiment of the present invention.

For signal levels that are higher than the nominal level, Type I error increases above that of the nominal level. On the other hand, for signal levels lower than the nominal level, Type II error increases. For the robust operation of the VAD 32 and those elements 36 of the coder that depend on the output of the VAD unit, it is preferred that the VAD 32 achieves approximately the same performance for all signal levels of interest. Thus, in accordance with an embodiment of the present invention, the level sensitivity of the VAD 32 is substantially reduced and preferably essentially eliminated for an improved overall performance of the coder and the noise reduction. As shown in FIG. 6, level sensitivity is reduced by providing an automatic gain control (AGC) module 74 prior to the VAD so that the signal level at the input to the VAD is always around the nominal level.

With reference to FIG. 6, the long-term RMS value of the input signal is updated at module 76 during the speech active periods indicated by the VAD 32. The difference between the signal level and the nominal level is computed via module 78. The incoming signal is subsequently multiplied via module 82 with a scaling factor determined via module 80 to bring the signal to the nominal level. The AGC module 74 preferably affects only the speech input into the VAD 32 to ensure a more reliable operation of the VAD 32. The speech input into the encoder 30 is not effected by the presence of the AGC module 74.

The operation of the AGC module 74 will now be described. The module 74 performs AGC gain multiplication as follows:

$$s'(n,k) = s_{HPF}(n,k) * \left[ g_{AGC}(k-1) * \frac{(n_l - n)}{(n_l - n_f + 1)} + g_{AGC}(k) * \frac{(n - n_f + 1)}{(n_l - n_f + 1)} \right] \quad (2)$$

wherein $S_{HPF}(n,k)$ is the high-pass filtered and scaled speech signal at the output of the HPF and scale module 34, $g_{AGC}(k)$ is the most recently updated AGC gain value, n is the sample index ranging from $n_f$ to $n_l$ and k is the frame index. The AGC gain computation (block 80) is as follows:

$$g_{AGC}(k) = \beta g_{AGC}(k-1) + (1-\beta) * 10^{\Delta(k)/20} \quad (3)$$

where β is a time constant $0 \leqq \beta \leqq 1$, and Δ(k) is the long-term RMS deviation from the nominal level for the current frame. The long-term RMS deviation from the nominal level for the current frame block 78) is as follows:

$$\Delta(k) -= -p_{dBov}(k) \quad (4)$$

where $p_{dBov}(k)$ is the current estimate of the long-term RMS signal level in dBov, which corresponds to signal level in decibels with respect to 16-bit overload (e.g., the maximum value in a 16-bit word being 32768). While the nominal level is −26 dBov, the effect of the HPF and scale module 34 is considered (i.e., a scale of ½). Thus, $\Delta(k)=-6-26-p_{dBov}(k)$ or $-32-p_{dBov}(k)$. Long-term RMS updating block 76) is as follows:

$$p_{dBov}(k)=\beta log_{10}p(k) \tag{5}$$

where $$p(k)=\gamma(k)*p(k-1)+(1-\gamma(k))*(e(k)/N) \tag{6}$$

and N is frame length, e(k) is frame energy. The parameter e(k) is:

$$e(k)=\sum_{i=n_f}^{i=n_l} s^2(i) \tag{7}$$

where s(i) is signal input scaled with respect to 16-bit overload, $n_f$ is the first sample of the current frame, $n_l$ is the last sample of the current frame, and $\gamma(k)=\min((k-1)/k, 0.9999)$.

The integrated AGC/VAD design described above can be used to effectively eliminate the level-sensitivity of the IS-641 VAD. Further, the solution is not specific to this particular coder. The AGC module 74 can be used to improve the performance of any VAD that exhibits input level sensitivity.

The operation of the VAD 32 has been described with reference to its steady state behavior. The VAD 32 operates reliably in the steady state and, for relatively longer segments of speech, its performance is satisfactory. The definition of a long segment of speech is preferably more than 500 frames or about 10 seconds of speech, which is easily obtainable for typical conversations. The transient behavior of the VAD 32, however, is such that, even if there is speech activity during the first 10 seconds or so, the VAD 32 does not detect the speech. Thus, all the updates that rely on the VAD 32 output, such as a noise estimate, can be compromised. While this transient behavior does not affect relatively long conversations, short conversations such as sentence pairs can be compromised by the VAD. For this reason, another variable is used to determine voice activity during the first 500 frames of speech in accordance with the present invention. A short-term noise update module 84 generates a short-term voice activity flag by making use of the stationarity, pitch, and tone flags. The overall VAD decision 42 is the logical OR'ing of the short-term and long-term flags. Therefore, for the first 500 frames of an input signal, the short-term flag is used. The long-term flag is used for subsequent frames. The short-term flag preferably does not completely replace the long-term flag because, while it improves performance of the VAD during the initial transient period, VAD performance would be degraded during later operation.

A method for implementing noise reduction in the noise reduction module 20 in accordance with the present invention will now be described with reference to FIG. 7. Single microphone methods and multi-microphone methods can be used for noise reduction. With single microphone methods, access to a noisy signal is through a single channel only. Thus, one noisy signal is all that is available for processing. In multi-microphone methods, however, signals can be acquired from several different places in an environment. Thus, more information about the overall environment is available. Accordingly, multi-microphone methods can make use of several different methods of processing, allowing for more accurate identification of noise and speech components and improved noise reduction.

It is not always possible, however, to make use of multi-microphone methods since lack of availability of more than one signal for processing is common to many applications. For example, in an application where cancellation of background noise at one end of a communications system from the other end of the system is desired, access to only the noisy signal is possible. Thus, a single microphone method of noise reduction is required. Cost is also a factor in selecting between single and multiple microphone noise reduction methods. Multi-microphone methods require an exclusive microphone array package. Thus, whenever cost is critical, single microphone techniques are frequently used.

One of the known methods of single microphone noise reduction is generalized spectral subtraction. This is a frequency domain method whereby the noise component of the signal spectrum is estimated and then subtracted from the overall input signal spectrum. Accordingly, a spectral subtraction method is dependent upon a reliable noise estimator. A reliable noise estimation algorithm is capable of reliably determining which portions of the signal are speech, and which portions are not. The role of the VAD 32 is therefore important to noise reduction.

There exist several variations of the spectral subtraction method, however, the basic ideas common to all these methods can be explained by the generalized spectral subtraction method. Let s(i) represent a speech signal, and n(i), noise. Then y(i) defined in:

$$y(i)=s(i)+n(i)\text{tm} \tag{8}$$

is a noisy speech signal. The same equation in the frequency domain is:

$$Y(w)=S(w)+N(w). \tag{9}$$

Y(w), S(w), and N(w) correspond to the short-time Fourier transform of y(i), s(i), and n(i) respectively. The time index from the short-time Fourier transform has been omitted for simplicity of notation.

Since it is not usually possible to obtain reliable phase information for the noise component, the noise reduction is performed in the spectral magnitude domain. Then the phase of the noisy speech signal is used in order to construct the output signal. The above relation in the spectral magnitude domain becomes:

$$|S(w)|=|Y(w)-N(w)|. \tag{10}$$

In spectral magnitude subtraction (SMS), the speech signal estimate is given as:

$$|\hat{S}(w)|=\begin{cases} |Y(w)|-|\hat{N}(w)|, & \text{if } |Y(w)|>|\hat{N}(w)| \\ 0, & \text{otherwise} \end{cases} \tag{11}$$

where $\hat{N}(w)$ is the estimate for the spectral magnitude of the noise.

It is possible to express the same relation in the form of a multiplication rather than a subtraction as follows:

$$|\hat{S}(w)|=|H_{SMS}(w)||Y(w)| \tag{12}$$

where $$|H_{SMS}(w)| = \begin{cases} 1 - \frac{|\hat{N}(w)|}{|Y(w)|}, & \text{if } |Y(w)| > |\hat{N}(w)| \\ 0, & \text{otherwise} \end{cases} \quad (13)$$

Thus, the spectral noise reduction process can be visualized as the multiplication of the noisy speech magnitude spectrum by an adaptive "gain" value that can be computed by equation (13).

The spectral magnitude subtraction is one of the variations of the spectral subtraction method of noise reduction. The method, in its most general form, has a gain value that can be computed as:

$$|H(w)| = \begin{cases} \left[1 - \gamma\left[\frac{|\hat{N}(w)|}{|Y(w)|}\right]^{\alpha}\right]^{\beta}, & \text{if } \left[\frac{|\hat{N}(w)|}{|Y(w)|}\right]^{\alpha} < 1 \\ 0, & \text{otherwise.} \end{cases} \quad (14)$$

Some of the variations on the spectral subtraction method and how they can be obtained from the generalized spectral subtraction can be seen in the following table:

TABLE 1

Variations on the spectral subtraction method

| α | β | γ | Method |
|---|---|---|---|
| 1 | 1 | 1 | Spectral magnitude subtraction |
| 2 | 0.5 | 1 | Spectral power subtraction |
| 2 | 1 | 1 | Approximated Wiener filter |

In the generalized spectral subtraction formula, γ controls the amount of noise reduction, whereas α and β are closely related to the intelligibility of the output speech.

Also included in the same conceptual framework as generalized spectral subtraction is the method of spectral amplitude enhancement. As with generalized spectral subtraction, spectral amplitude enhancement performs spectral filtering by using a gain function which depends on the input spectrum and a noise spectral estimate. The gain function used by the noise reduction module 20 is preferably in accordance with a spectral amplitude enhancement scheme and can be expressed as:

$$|H(w)| = \frac{\left(\frac{|Y(w)|}{\alpha}\right)^{v}}{\left[1 + \left(\frac{|Y(w)|}{\alpha}\right)^{v}\right]} \quad (15)$$

where α is a threshold, Y(w) is the input noisy speech magnitude spectrum. By using this method, spectral magnitudes smaller than a are suppressed, while larger spectral magnitudes do not undergo change. The transition area can be controlled by the choice of ν. A large value causes a sharp transition, whereas a small value would ensure a large transition area.

In order to prevent distorting the signal during periods of low amplitude speech, the spectral variance concept is introduced:

$$\gamma^2 = \frac{1}{N}\sum_{w=1}^{N}(|Y(w)| - |\bar{Y}(w)|)^2 \quad (16)$$

where $|\bar{Y}(w)|$ is the average spectral magnitude. By including the spectral variance factor, the threshold value becomes frequency dependent and is given as:

$$\alpha(w) = \frac{C \cdot |\hat{N}(w)|^2}{\gamma} \quad (17)$$

where C is a constant and $|\hat{N}(w)|$ is the smoothed noise spectral estimate. The spectral amplitude enhancement method usually results in less spectral distortion when compared to generalized spectral subtraction methods, and it is the preferred method for the noise reduction module 20.

A number of factors control a trade-off between the amount of noise reduction and spectral distortion that is introduced in cases of low signal-to-noise ratio (SNR). One such factor is the constant C described above. A second factor is a lower limit K, which is enforced on the gain function, |H(w)|, that is, if |H(w)|<K then |H(w)|=K. An estimate of the SNR is preferably provided via the VAD 32 and updated at each speech frame processed by the noise reduction module 20. This SNR estimate for frame k is based on the long-term speech level $p_{dBov}(k)$ that has been computed in the AGC (e.g., see equations (5) through (7)) and a long-term noise level $q_{dBov}(k)$ that is computed in a similar manner, that is, $q_{dBov}(k)=10\log_{10}q(k)$ where $q(k)=\gamma(k)^* q(k-1)+(1-\gamma k))^*q_N(k)$. Here, γ(k) is the same as in equation (6) used in AGC. The parameter $q_N(k)$ is the noise power in the smoothed noise spectral estimate $|\hat{N}(w)|$ for frame index k and is computed directly in the frequency domain.

At low SNRs, a small value of C (e.g., approximately 1) is selected. Accordingly, a lower threshold value of α is produced, which in turn enables an increased number of speech spectral magnitudes to pass the gain function unchanged. Thus, a smaller value C results in reduced spectral distortion at low SNRs. At higher SNRs, a larger value of C (e.g., approximately 1.7) is selected. Accordingly, a higher value of α is produced, which enables an increased amount of noise reduction while minimizing speech distortion.

In addition, at low SNRs, a high value of K (e.g., approximately 1) is selected. While decreasing noise reduction, this value of K preserves spectral magnitudes that can be masked by high levels of noise, resulting in smoothly evolving residual noise that is pleasing to a listener. A higher SNRs, a low value of K (e.g., close to zero) is selected. Thus, noise reduction increases and smoothly evolving low level residual noise is achieved.

In accordance with another aspect of the present invention, both the noisy input speech spectrum and the noise spectral estimate that are used to compute the gain are smoothed in the frequency domain prior to the gain computation. Smoothing is necessary to minimize the distortions caused by inaccurate gain values due to excessive variations in signal spectra. The method used for frequency smoothing is based on the critical band concept. Critical bands refer to the presumed filtering action of the auditory system, and provide a way of dividing the auditory spectrum into regions similar to the way a human ear would, for example. Critical bands are often utilized to make use of masking, which refers to the phenomenon that a stronger auditory component may prevent a weak one from being heard. One way to represent critical bands is by using a bank of non-uniform bandpass filters whose bandwidths and center frequencies roughly correspond to a ⅙ octave filter bank The center frequencies and bandwidths of the first 17 critical bands that span our frequency area of interest are as follows:

TABLE 2

Critical Band Frequencies

| Center Frequency (Hz) | Band-width (Hz) |
|---|---|
| 50 | 80 |
| 150 | 100 |
| 250 | 100 |
| 350 | 100 |
| 450 | 100 |
| 570 | 120 |
| 700 | 140 |
| 840 | 150 |
| 1000 | 160 |
| 1170 | 190 |
| 1370 | 210 |
| 1600 | 240 |
| 1850 | 280 |
| 2150 | 320 |
| 2500 | 380 |
| 2900 | 450 |
| 3400 | 550 |

In accordance with the smoothing scheme used by the noise reduction module 20, the RMS value of the magnitude spectrum of the signal in each critical band is first calculated. This value is then assigned to the center frequency of each critical band. The values between the critical band center frequencies are linearly interpolated. In this way, the spectral values are smoothed in a manner that takes advantage of auditory characteristics.

The noise reduction algorithm used with the noise reduction module 20 of the present invention will now be described with reference to FIG. 7. As indicated in block 90, each frame of a 160 sample input speech signal goes through a windowing and fast Fourier transform (OFT) process. The window 86 is preferably a modified trapezoidal window of 120 samples and ⅓ overlap 88, as illustrated in FIG. 8. The FFT size is preferably 256 points. A noise flag is provided, as shown in block 92. For example, the VAD 32 can be used to generate a noise flag. The noise flag can be the inverse of the voice activity flag. As shown in block 94, the noise spectrum is estimated. For example, when a frame is identified as having noise (e.g., by the VAD 32), the level and distribution of noise over a frequency spectrum is determined. The noise spectrum is updated in response to the noise flags. The estimate of the noise spectral magnitude is then smoothed by critical bands as described above and updated during the signal frames that contain noise.

Figure 7:
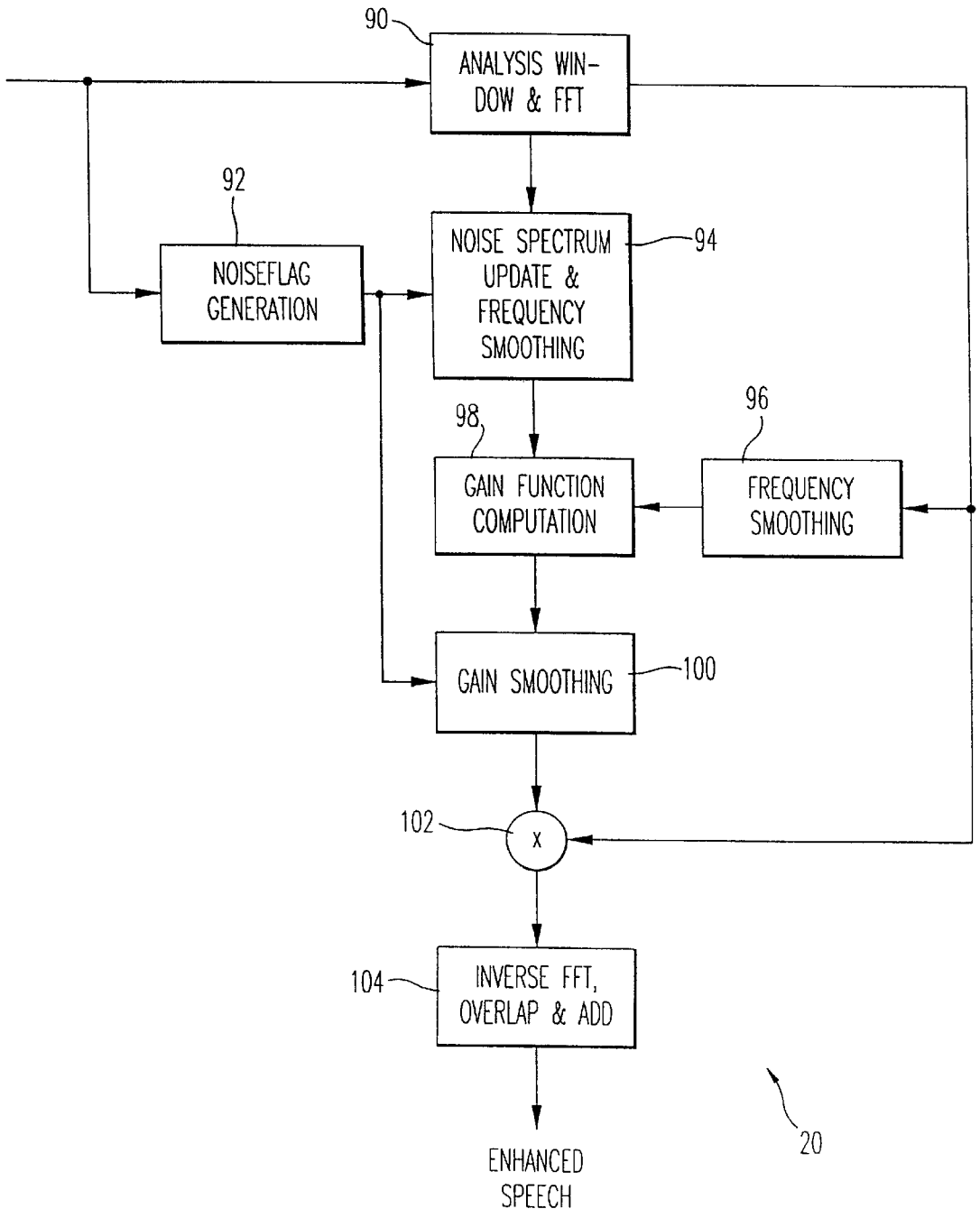
FIG. 7 is flow chart depicting a sequence of operations for noise reduction in accordance with an embodiment of the present invention.
Figure 8:
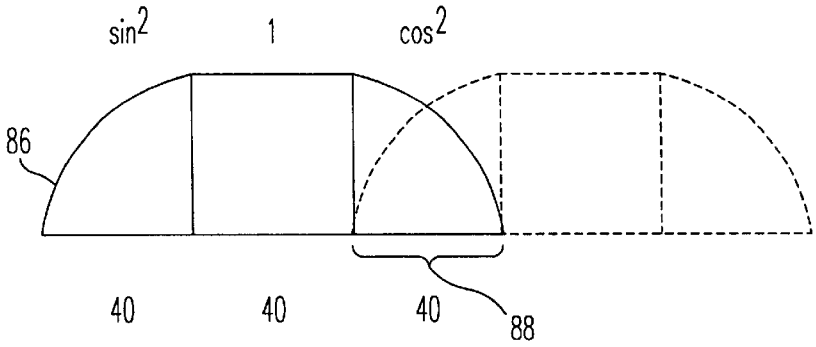
FIG. 8 depicts a window for use in a noise reduction algorithm in accordance with an embodiment of the present invention.

With continued reference to FIG. 7, gain functions are computed (block 98) as described above using the smoothed noise spectral estimate and the input signal spectrum, which is also smoothed (block 96). As indicated in block 100, gain smoothing is performed to prevent artifacts in the speech output. This step essentially eliminates the spurious gain components that are likely to cause distortions in the output. Gain smoothing is performed in the time domain by using concepts similar to those used in compandors. For example, $$g(i) = \begin{cases} a \cdot g(i-1), & \text{if } a \cdot g(i-1) < g(i) \\ b \cdot g(i-1), & \text{if } b \cdot g(i-1) > g(i) \\ g(i), & \text{otherwise} \end{cases} \tag{18}$$

where g(i) is the computed gain, i is the time index, a>1, b<1 and a and b are attack and release constants, respectively. After the smoothed gain values are multiplied by the input signal spectra (block 102), the time domain signal is obtained by applying inverse FFT on the frequency domain sequence, followed by an overlap and add procedure (block 104). The values of a and b are chosen based on the signal-to-noise ratio (SNR) estimate obtained from the VAD 32 and on the voice activity indicator signal (e.g., VAD flag). During frames or segments classified as noise and for moderate-to-high SNRs, a and b are chosen to be very close to 1. This results in a highly constrained gain evolution across frames which, in turn, results in smoother residual background noise. During frames or segments classified as noise and for low SNRs, the value of a is preferably increased to 1.6, and the value of b is preferably decreased to 0.4, since the VAD 32 is less reliable. This avoids spectral distortion during misclassified frames and maintains reasonable smoothness of residual background noise.

During segments classified as containing voice activity and for moderate-to-low SNRs, the value of a is preferably ramped up to 1.6, and b is preferably ramped down to 0.4. This results in moderate constraints on the evolution of the gain across segments and results in reduced discontinuities or artifacts in the noise-reduced speech signal. During segments classified as voice active and for high SNRs (e.g., greater than 30 dB) the value of a is preferably ramped up to 2.2, and the value of b is ramped up to 0.8. This results in a lesser attack limitation and a greater release limitation on the gain signal. Such a scheme results in lower alternation of voice onsets and trailing segments of voice activity, thus preserving intelligibility.

The values provided for a and b in the preferred embodiment were derived empirically and are summarized in Table 3 below. It is to be understood that for different codecs and different acoustic microphone front-ends, an alternative set of values for a and b may be optimal.

TABLE 3

Attack and Release Constants

| VAD flag | SNR Estimate | a | b |
|---|---|---|---|
| 0 | moderate to high (>10 dB) | 1.1 | 0.9 |
| 0 | low | ramped up from 1.1 to 1.6 | ramped down from 0.9 to 0.4 |
| 1 | moderate to low (<30 dB) | 1.6 | 0.4 |
| 1 | high | ramped up from 1.6 to 2.2 | ramped down from 0.4 to 0.8 |

During long pauses, encoded background noise is seen to exhibit an artifact that is best described as "swirl". The occurrence of swirl can be shown to be mostly due to the presence of spectral shape outliers and long-term periodicity introduced by the encoder 30 during background noise. The swirl artifact can be minimized by smoothing spectral outliers and reducing long-term periodicity introduced in the encoded excitation signal.

During uncoded background noise, the noise spectrum is seen to vary slowly and in a smooth fashion with time. The same background noise after coding exhibits a rougher behavior in its time contour. These spectral outlier frames are detected by comparing an objective measure of spectral similarity to an experimentally determined threshold. The spectral similarity measure is a line spectral frequency or LSF-based Euclidean distance measure between the current spectrum and a weighted average of past noise spectra. Noise spectra are preferably identified using a flag (e.g., provided by the VAD) that indicates the presence or absence of voice. Once the spectral outlier frame is detected, the LSF parameters of that frame are replaced by the weighted average LSF of past noise spectra to ensure smooth spectral variation of encoded background noise.

The encoder 30 is seen to introduce excess long-term periodicity during long background noise segments. This long-term periodicity mostly results from an increase in the value of adaptive codebook gain during background noise. In accordance with another aspect of the present invention, an upper bound of preferably 0.3 is enforced on the adaptive codebook gain during frames that are identified as voice inactive by the VAD 32. This upper bound ensures a limited amount of long-term periodic contribution to the encoded excitation and thus reduces the swirl effect.

Figure 9:
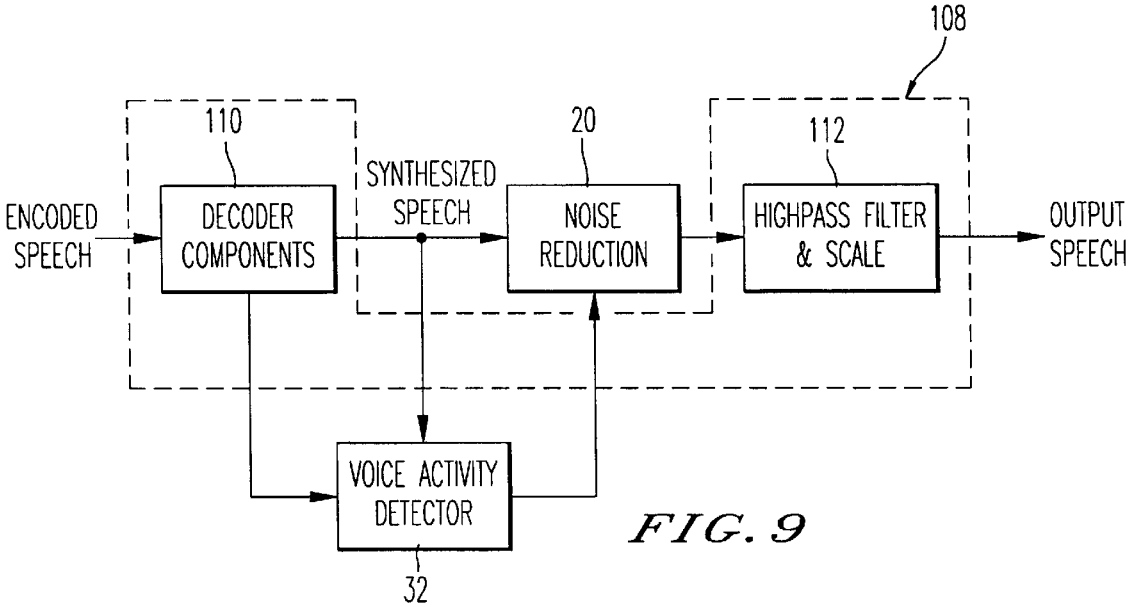
FIG. 9 is a block diagram of an enhanced decoder having integrated noise reduction and voice activity functions configured in accordance with an embodiment of the present invention.

In the post-compression mode for the exemplary IS-641 system depicted in FIG. 9, the main components of the system are the VAD 32 and the noise reduction module 20. Unlike the encoder 30, the decoder 108 does not contain a swirl reduction function, as discussed below. HPF and scale module is contained in a standard IS-641 decoder, and is represented here as a separate unit 112 from other decoder components 110 to illustrate the locations of the VAD 32 and the noise reduction module 20 with respect to the rest of the system.

Figure 10:
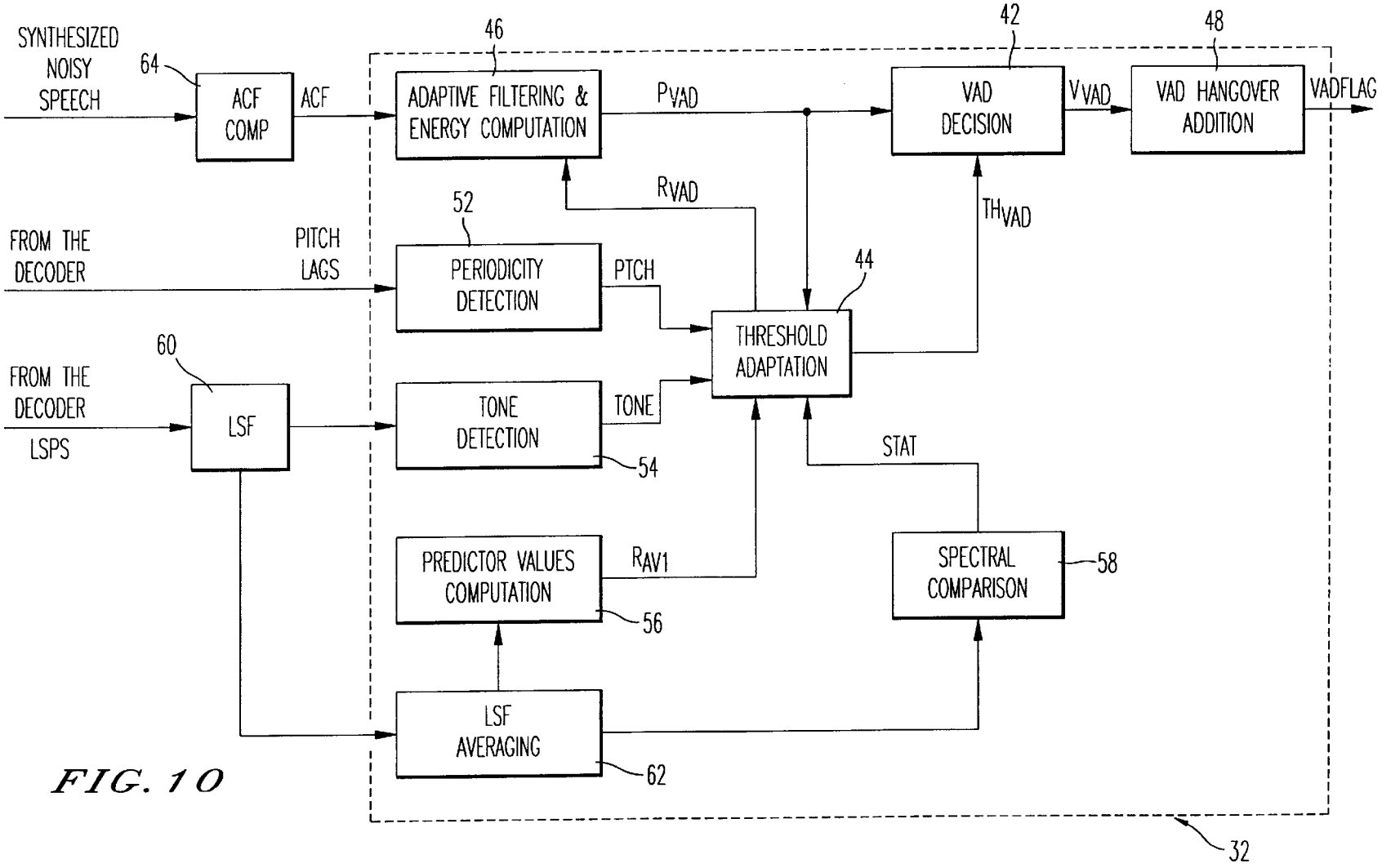
FIG. 10 is a block diagram of a voice activity detector configured for use with a decoder in accordance with an embodiment of the present invention.

A VAD 32 is used in the post-compression mode, as well as in the pre-compression mode, to facilitate the operation of the noise reduction algorithm of the present invention. The VAD 32 utilized in the post-compression mode is similar to the VAD 32 used in for pre-compression noise reduction (e.g., FIG. 5), excepts with a few changes in the way the input parameters to the VAD 32 are computed as indicated in FIG. 10.

Figure 11:
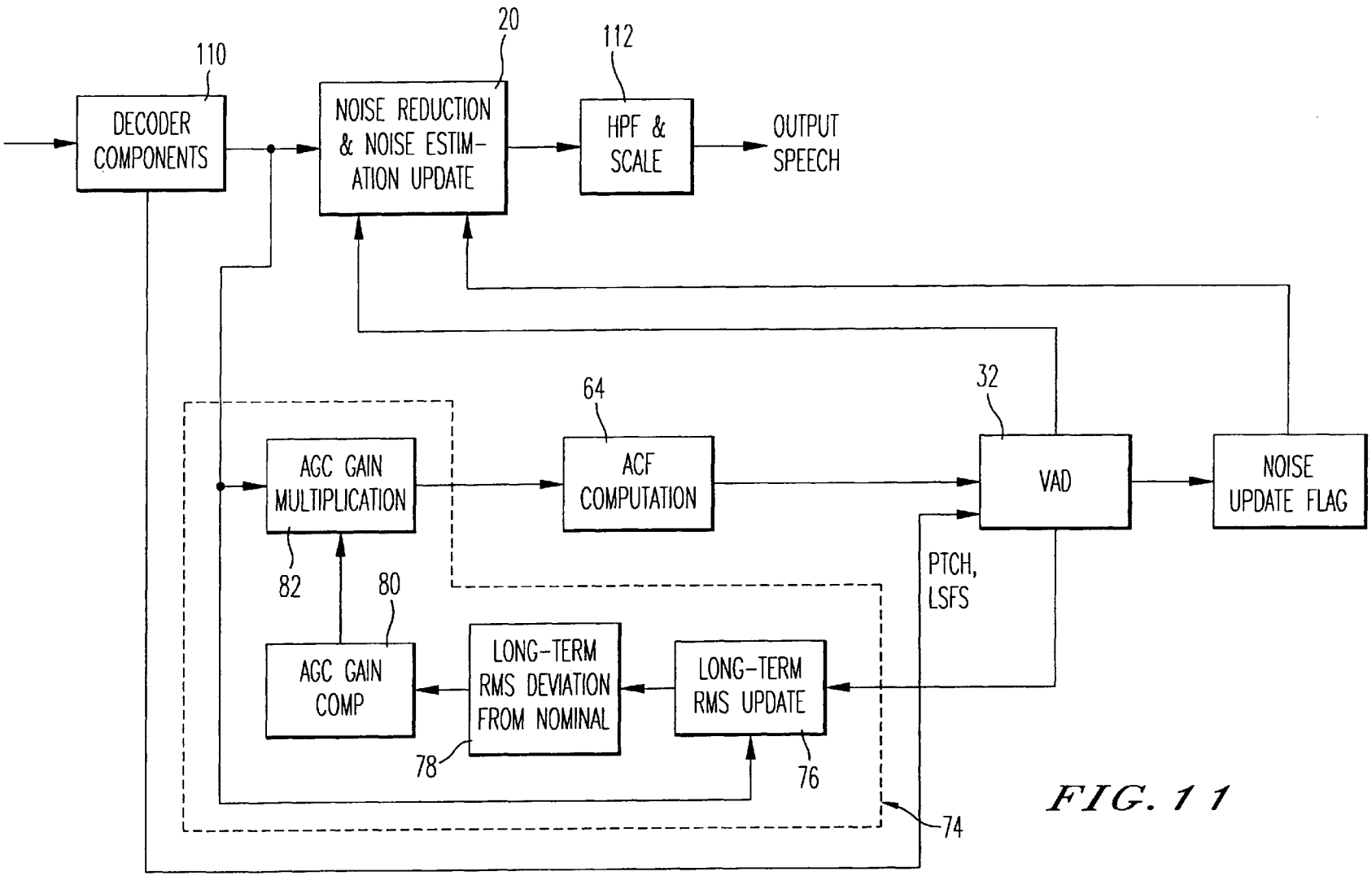
FIG. 11 is a block diagram of a voice activity detector configured with automatic gain control for use with a decoder in accordance with an embodiment of the present invention.

VAD operation in the post-compression configuration also displays a level sensitivity similar to the pre-compression configuration. Accordingly, as with the case of the pre-compression mode, an AGC module 74 is used prior to the VAD 32 in the post-compression scheme to essentially eliminate level sensitivity, as illustrated in FIG. 11. The AGC module 74 operation in the post-processing configuration is the same as that of the pre-compression configuration. In addition, the same noise reduction scheme described above in connection with FIG. 7 that is used in the pre-compression configuration is also being used in the post-compression. Unlike the pre-compression scheme, no swirl reduction feature is utilized in the post-compression.

Although the present invention has been described with reference to a preferred embodiment thereof, it will be understood that the invention is not limited to the details thereof. Various modifications and substitutions have been suggested in the foregoing description, and others will occur to those of ordinary skill in the art. All such substitutions are intended to be embraced within the scope of the invention as defined in the appended claims.

What is claimed is:

1. A method of reducing noise in an input speech signal having digitized samples comprising the steps of:

dividing said input speech signal into segments comprising a selected number of said samples using a selected window function;

processing said segments using a Fourier analysis to obtain input noisy speech spectra of said input speech signal;

estimating the noise spectral magnitude of said samples to generate a noise spectral estimate;

smoothing said noise spectral estimate and said input noisy speech spectra;

computing a gain function using said noise spectral estimate and said input noisy speech spectra which have been smoothed;

generating speech signal spectra using said input noisy speech spectra and said gain function; and performing an inverse Fourier process on said speech signal spectra to obtain a reduced noise speech signal.

2. A method as claimed in claim 1, further comprising the steps of:

determining when said input speech signal contains only noise; and updating said noise spectral magnitude when said noise is detected.

3. A method as claimed in claim 1, wherein said generating step comprises the step of performing at least one of a plurality of noise reduction processes comprising spectral subtraction, spectral magnitude subtraction, spectral power subtraction, spectral amplitude enhancement, an approximated Wiener filter, and spectral multiplication.

4. A method as claimed in claim 1, further comprising the step of smoothing said gain function prior to said generating step.

5. A method as claimed in claim 4, wherein said step of smoothing said gain comprises the steps of:

classifying said segments of said input speech signal as one of noise and voice activity; and employing an attack constant and a release constant with said gain, said attack constant and said release constant being selected depending on a signal-to-noise ratio of said input speech signal and whether said segments are classified as said noise or said voice activity.

6. A method as claimed in claim 5, wherein said employing step comprises the step of selecting said attack constant and said release constant to be a value of approximately 1.0 for a moderate-to-high said signal-to-noise ratio and said segments classified as said noise.

7. A method as claimed in claim 5, wherein said employing step comprises the step of increasing said attack constant above a value of 1.0 and decreasing said release constant below said value for a low said signal-to-noise ratio and said segments classified as said noise.

8. A method as claimed in claim 5, wherein said employing step comprises the step of increasing said attack constant above a value of 1.0 and decreasing said release constant below said for a low-to-moderate said signal-to-noise ratio and said segments classified as said voice activity.

9. A method as claimed in claim 8, wherein said employing step comprises the step of further increasing said attack constant and in creasing said release constant while maintaining said release constant below said unity a high said signal-to-noise ratio and said segments classified as said voice activity.

10. A method as claimed in claim 1, wherein said computing step comprises the step of calculating said gain function using a threshold value, said threshold value being adjusted in accordance with a signal-to-noise ratio of said input noisy speech signal.

11. A method as claimed in claim 1, wherein said computing step comprises the step of using a lower limit value with said gain function, said lower limit value being adjusted depending on a signal-to-noise ratio of said input noisy speech signal.

12. A method as claimed in claim 1, wherein said smoothing step comprises the step of smoothing using selected critical frequency bands corresponding to the human auditory system.

13. A method as claimed in claim 12, wherein said smoothing step comprises the steps of:

calculating the root mean square value of the spectral magnitude of said input speech signal in each of said selected critical frequency bands;

assigning said root mean square value in each of said selected critical frequency bands to the center frequency thereof; and determining values between the center frequencies of said selected critical frequency bands via interpolation.

14. A method as claimed in claim 1, wherein said reduced noise speech signal is provided to an encoder and further comprising the steps of:

generating an encoded speech signal using said reduced noise speech signal, said encoded speech signal comprising reduced background noise, said background noise including swirl artifacts; and reducing said swirl artifacts introduced into said reduced background noise via said encoder.

15. A method as claimed in claim 14, wherein said reducing step comprises the step of:

detecting the presence of noise;

determining a weighted average of noise spectra corresponding to said noise;

determining a distance measurement between current noise spectra corresponding to said noise and said weighted average; and comparing said distance measurement with a selected threshold to identify spectral outlier segments of said reduced background noise.

16. A method as claimed in claim 15, further comprising the steps of:

determining weighted average line spectral frequencies of said segments identified as spectral outlier segments, and of said weighted average of noise spectra; and replacing line spectral frequencies corresponding to said segments identified as spectral outlier segments with said weighted average line spectral frequencies.

17. A method as claimed in claim 1, wherein said reduced noise speech signal is provided to an encoder and further comprising the steps of:

identifying segments of said reduced noise speech signal which do not contain a minimal threshold of speech; and providing an upper limit on long-term periodicity employed by said encoder during said segments identified as not satisfying said minimal threshold of speech.

18. A method of determining whether speech is present in a frame of an input signal characterized by a plurality of frames, wherein the input signal can comprise additive background noise, the method comprising the steps of:

performing a noise reduction process on said input signal to generate an enhanced input signal;

computing pitch lag using said enhanced input signal;

determining a representation of said noise in said input signal;

selecting a threshold corresponding to an energy level of said input signal at which said input signal is determined to comprise speech;

obtaining autocorrelation function coefficients corresponding to said frame of said input signal;

updating at least one of said representation of said noise and said threshold using a threshold adaptation process involving at least one of a plurality of characteristics of said input signal comprising tone, pitch, predictor values and said autocorrelation function coefficients, said pitch being determined via periodicity detection using said pitch lag;

adaptively filtering said autocorrelation function coefficients using said representation of said noise to generate an input signal energy parameter; and comparing said input signal energy parameter with said threshold.

19. A method as claimed in claim 18, further comprising the step of generating a voice activity detection indication signal when said input signal energy parameter exceeds said threshold.

20. A method as claimed in claim 18, further comprising the steps of:

determining line spectrum frequencies using said autocorrelation function coefficients; and using said line spectrum frequencies to determine at least one of said plurality of characteristics of said input signal.

21. A method as claimed in claim 18, further comprising adjusting said input signal prior to generating autocorrelation function coefficients to reduce level sensitivity.

22. A method as claimed in claim 18, further comprising the step of determining gain for multiplying with said input signal to reduce level sensitivity.

23. A method as claimed in claim 22, wherein said determining step for said gain comprises the steps of:

comparing the signal level of a current one of said plurality of frames with a previous one of said plurality of frames;

updating a long-term root mean square value using the signal level of said current frame, said long-term root mean square value having been determined using previous ones of said plurality of frames;

subtracting said long-term root mean square value from a selected nominal signal level to determine a deviation value;

updating said gain using said deviation and said gain as determined for said previous one of said plurality of frames; and interpolating said gain over samples in one of said plurality of frames.

24. A voice activity detector for determining whether speech is present in a frame of an input signal, wherein the input signal can comprise additive background noise, comprising:

a long-term voice activity detector operable to detect speech during a portion of said input signal;

a short-term voice activity detector operable to detect speech during an initial predetermined number of frames of said input signal; and a logical OR device for using an output generated via said short-term voice activity detector during said initial predetermined number of frames of said input signal and said long-term voice activity detector thereafter, said short-term voice activity detector and said long-term voice activity detector each being operable to generate an indication for when said speech is present as said output.

25. A speech encoder with integrated noise reduction comprising:

a voice activity detection module;

a frame delay device;

an encoder operable to receive signals from said voice activity detection module and to provide delayed pitch lag to said voice activity detection module;

a noise reduction module; and a high-pass filter and scale module for receiving and processing input speech signals and providing input signals to said voice activity detection module and to said noise reduction module, said voice activity detection module processing said input signals and generating a first output signal as an input to said noise reduction module to indicate the presence of voice in said input signal, said noise reduction module being operable to process said input signals and generate a first output signal for input to said encoder;

said voice activity detection module being operable to receive autocorrelation function coefficients, to determine line spectral frequencies from said autocorrelation function coefficients, and to perform at least one of a plurality of functions comprising using line spectral frequencies comprising tone detection, predictor values computation and spectral comparison;

said noise reduction module being operable to generate enhanced input speech signals by processing said input signals to reduce noise therein and to provide enhanced pitch lag to said voice activity detection module via said frame delay device, said encoder determining said enhanced pitch lag from said enhanced input speech signals.

26. An encoder as claimed in claim 25, wherein said input signals to said voice activity detector module are multiplied by a selected gain when said second output signal indicates the presence of voice in said input speech signals.

27. A speech encoder with integrated noise reduction comprising:

a voice activity detection module;

a frame delay device;

a noise reduction module;

an encoder operable to receive signals from said noise reduction module and to provide delayed pitch lag to said voice activity detection module; and a high-pass filter and scale module for receiving and processing input speech signals and providing an output signal to said voice activity detection module and to said noise reduction module, said voice activity detection module being operable to process said output signal and generate an output signal as input to said noise reduction module, said noise reduction module being operable to process said output signal and generate an output signal as input to said encoder, said voice activity detection module generating a second output signal as an input to said noise reduction module to indicate the presence of noise in said input speech signals;

said noise reduction module being operable to generate a noise spectral estimate of said noise, to obtain noisy speech spectra from said input speech signals, to smooth said noise spectral estimate and said noisy speech spectra, to compute a gain using the smooth said noisy speech spectra, to smooth said gain, and to generate noise reduced speech signal spectra using said noisy speech spectra and said gain.

28. An encoder as claimed in claim 27, wherein noise reduced speech spectra is obtained using spectral amplitude enhancement in said noise reduction module.

29. An encoder as claimed in claim 27, wherein said speech signal spectra is generated using one of a plurality of noise reduction processes comprising spectral subtraction, spectral magnitude subtraction, spectral power subtraction, spectral amplitude enhancement, an approximated wiener filter, and spectral multiplication.

30. An encoder as claimed in claim 27, wherein said noise reduction module smoothes said noise spectral estimate and said noisy speech spectra using selected critical frequency bands corresponding to the human auditory system.

31. An encoder as claimed in claim 30, wherein said noise reduction module smoothes said noise spectral estimate and said noisy speech spectra by calculating the root mean square value of the spectral magnitude of said input speech signal in each of said selected critical frequency bands, assigning said root mean square value in each of said selected critical frequency bands to the center frequency thereof, and determining values between the center frequencies of said selected critical frequency bands via interpolation.

32. A speech decoding apparatus with integrated noise reduction for decoding encoded signals comprising:

a decoder for decoding said encoded signals to generate decoded output signals;

a voice activity detection module operable to generate a first indicator signal indicating the presence of voice in decoded said output signals, said first indicator signal being used to generate a second indicator signal to indicate when decoded said output signals comprise noise;

a noise reduction module operable to receive said output signals from said decoder and said second indicator signal from said voice activity module, and to process said output signals to reduce noise therein and generate enhanced speech signals, said noise reduction module being operable to generate a noise spectral estimate and to update said noise spectral estimate using said second indicator signal, to generate noisy speech spectra using said output signals, to smooth said noisy speech spectra and said noise spectral estimate, to compute a gain using the smoothed noisy speech spectral, to smooth said gain and to generate said enhanced speech signals using said gain and said noisy speech spectra, said enhanced speech signals being provided to said decoder for high-pass filtering and scaling.

33. A decoding speech apparatus as claimed in claim 32, wherein said noise reduction module generates said enhanced speech signals using spectral amplitude enhancement.

34. A decoding speech apparatus as claimed in claim 32, wherein said noise reduction module smoothes said noise spectral estimate and said noisy speech spectra using selected critical frequency bands corresponding to the human auditory system.

35. A decoding apparatus as claimed in claim 32, wherein said noise reduction module smoothes said noise spectral estimate and said noisy speech spectra by calculating the root mean square value of the spectral magnitude of said input speech signal in each of said selected critical frequency bands, assigning said root mean square value in each of said selected critical frequency bands to the center frequency thereof, and determining values between the center frequencies of said selected critical frequency bands via interpolation.

36. A decoding apparatus as claimed in claim 32, wherein said noise reduction module calculates said gain using a threshold value, and adjusts said threshold value to reduce spectral distortion when said output signals are characterized by low signal-to-noise ratios.

37. A decoding apparatus as claimed in claim 32, wherein said noise reduction module uses a lower limit value with said gain, said lower limit value being adjusted depending on the signal-to-noise ratio of said output signals.

38. A speech decoding apparatus with integrated noise reduction for decoding encoded signals comprising:

a decoder for decoding said encoded signals to generate output signals;

a voice activity detection module operable to receive pitch lag data and line spectral frequencies from said decoder, said voice activity module being operable to perform periodicity detection using said pitch lag data and at least one of a plurality of functions comprising tone detection, predictor values computation and spectral comparison using said line spectral frequencies to generate a first indicator signal indicating the presence of voice in said encoded signals;

a noise reduction module operable to receive said output signals from said decoder and said first indicator signal from said voice activity module, and to process said output signals to reduce noise therein and generate enhanced speech signals, said enhanced speech signals being provided to said decoder for high-pass filtering and scaling.

39. A speech decoding apparatus as claimed in claim 38, wherein said voice activity detector also performs automatic gain control to reduce level sensitivity.

40. A speech decoding apparatus as claimed in claim 38, wherein said output signals comprises frames, said voice activity detector being operable to select a nominal level for said frames of said output signals, to perform root mean square computations on the levels of said frames when said first indicator signal indicates that said frames comprise speech, to generate a gain using said root mean square computations corresponding to deviation of said frames from said nominal level, and to use said gain on said output signals.

41. A speech decoding apparatus as claimed in claim 38, wherein said noise reduction module is provided with a second indicator signal which indicates when said encoded signals comprise noise, and is operable to generate a noise estimate, said noise reduction module updating said noise estimate using said second indicator signal.

* * * * *